US006899257B2

(12) United States Patent
Jones

(10) Patent No.: US 6,899,257 B2
(45) Date of Patent: May 31, 2005

(54) UTILITY BELT ASSEMBLY

(76) Inventor: Tony Jones, 3904 Victory Ct., Flower Mound, TX (US) 75028

( * ) Notice: Subject to any disclaimer, the term of this patent is extended or adjusted under 35 U.S.C. 154(b) by 127 days.

(21) Appl. No.: 10/412,803

(22) Filed: Apr. 14, 2003

(65) Prior Publication Data

US 2004/0200873 A1 Oct. 14, 2004

(51) Int. Cl.[7] ..... A45F 3/00

(52) U.S. Cl. ..... 224/680; 224/240; 224/241; 224/681; 224/682; 224/930

(58) Field of Search ..... 224/236, 240, 224/241, 653, 654, 655, 660, 663, 676, 680, 681, 682, 930; 220/520; 150/112, 116

(56) References Cited

U.S. PATENT DOCUMENTS 2,324,194 A * 7/1943 Campiglia ..... 224/236
2,612,199 A * 9/1952 Schocket ..... 150/112
3,335,775 A * 8/1967 Adams ..... 150/116
4,047,650 A * 9/1977 Domingos ..... 224/236
4,796,790 A * 1/1989 Hamilton ..... 224/241
4,890,741 A * 1/1990 Edelstein ..... 220/520
5,230,452 A * 7/1993 Wagner ..... 224/240
5,395,023 A * 3/1995 Naymark et al. ..... 224/682
6,193,118 B1 * 2/2001 Kearl ..... 224/655
6,230,952 B1 * 5/2001 Jupiter ..... 224/655
6,382,490 B1 * 5/2002 Divincenzo ..... 224/681
6,655,565 B2 * 12/2003 Godshaw et al. ..... 224/653

* cited by examiner

*Primary Examiner*—Gary E. Elkins
(74) *Attorney, Agent, or Firm*—John E. Vandigriff

(57) ABSTRACT

A utility belt assembly for use with electronic devices such as electronic game devices, cellular telephones, and digital cameras has one principal pouch or container, and may have several smaller ones for cellular telephones, and other electronic related devices. The principal container has a large pocket into which a game electronic device or other device may be stored while not in use. A folding unit extends out from the principle container and has a plurality of storage pouches or pockets into which may be placed, for example memory devices, game cartridges, and batteries. The folding unit is attached to the bottom of the principal pouch and will fold back upon itself and the front of the principal pouch. A cover attached to the top back of the principal pouch, when closed, encloses the principal pouch and the folding unit.

14 Claims, 3 Drawing Sheets

UTILITY BELT ASSEMBLY

FIELD OF THE INVENTION

The invention relates to utility belts for carrying various objects, and more particularly to a utility belt for carrying and storing electronic games and other apparatus, and items for use with electronic devices including memory devises and batteries.

BACKGROUND OF THE INVENTION

U.S. Pat. No. 5,121,865 describes a belt-carried holster which includes a slitted back plate engaged by a waist belt. Two pairs of complementary hook and loop flexible fastener strips are connected to the back plate and interconnected in pairs in cross-overlapping fashion, for containment of a cassette player against the back plate. At least some of the fastener strips are connected indirectly to the back plate, via flexible cords, which may be slightly elastic.

U.S. Pat. No. 4,907,729 describes a system for carrying articles includes belt structure and at least one detachably connectable carrying structure such as a pouch. The pouch includes direct attachment structure for securing the pouch to the belt. Loop structure on the pouch is adapted to encircle the belt whereby if the direct attachment structure becomes disengaged, the indirect attachment structure will hold the pouch to the belt. The direct attachment structure and indirect attachment include hook and loop fastening means. The method of manufacturing a diver's belt having at least one pouch for a lead weight including direct attachment means and indirect attachment means constructed of hook and loop fasteners.

A portable substitute for the conventional tackle box is described in U.S. Pat. No. 4,957,231. The tackle box belt comprises a waist belt to which a plurality of pockets and loop hangers are selectively attached.

A multi-purpose utility belt described in U.S. Pat. No. 6,073,823 includes an elongated planar strap having first and second ends with an attachment means adjacent each end thereof for securing the strap about a user's abdomen. Depending from the lower edge of the strap is a panel having a hook-and-loop fastener adjacent each of its four peripheral edges. A wiping cloth having similarly disposed hook-and-loop fasteners on a side thereof is removably attachable to the panel. A plurality of tool holding pockets are removably attached to the exterior surface of the strap allowing a user to selectively configure the belt. Each pocket is designed to retain a select tool such as a paint brush, a caulking gun and similar items.

SUMMARY OF THE INVENTION

The invention is a utility belt assembly for use with electronic devices such as electronic game devices, cellular telephones, and digital cameras. The utility belt assembly has one principal pouch or container, and may have several smaller ones. The principal container has a large pocket into which a game electronic device or other device may be stored while not in use. A folding unit extends out from the principle container and has a plurality of storage pouches or pockets into which may be placed, for example memory devices, game cartridges, and batteries. The folding unit is attached to the bottom of the principal pouch and will fold back upon itself and the front of the principal pouch. A cover attached to the top back of the principal pouch, when closed, encloses the principal pouch and the folding unit.

DESCRIPTION OF A PREFERRED EMBODIMENT

Figure 1:
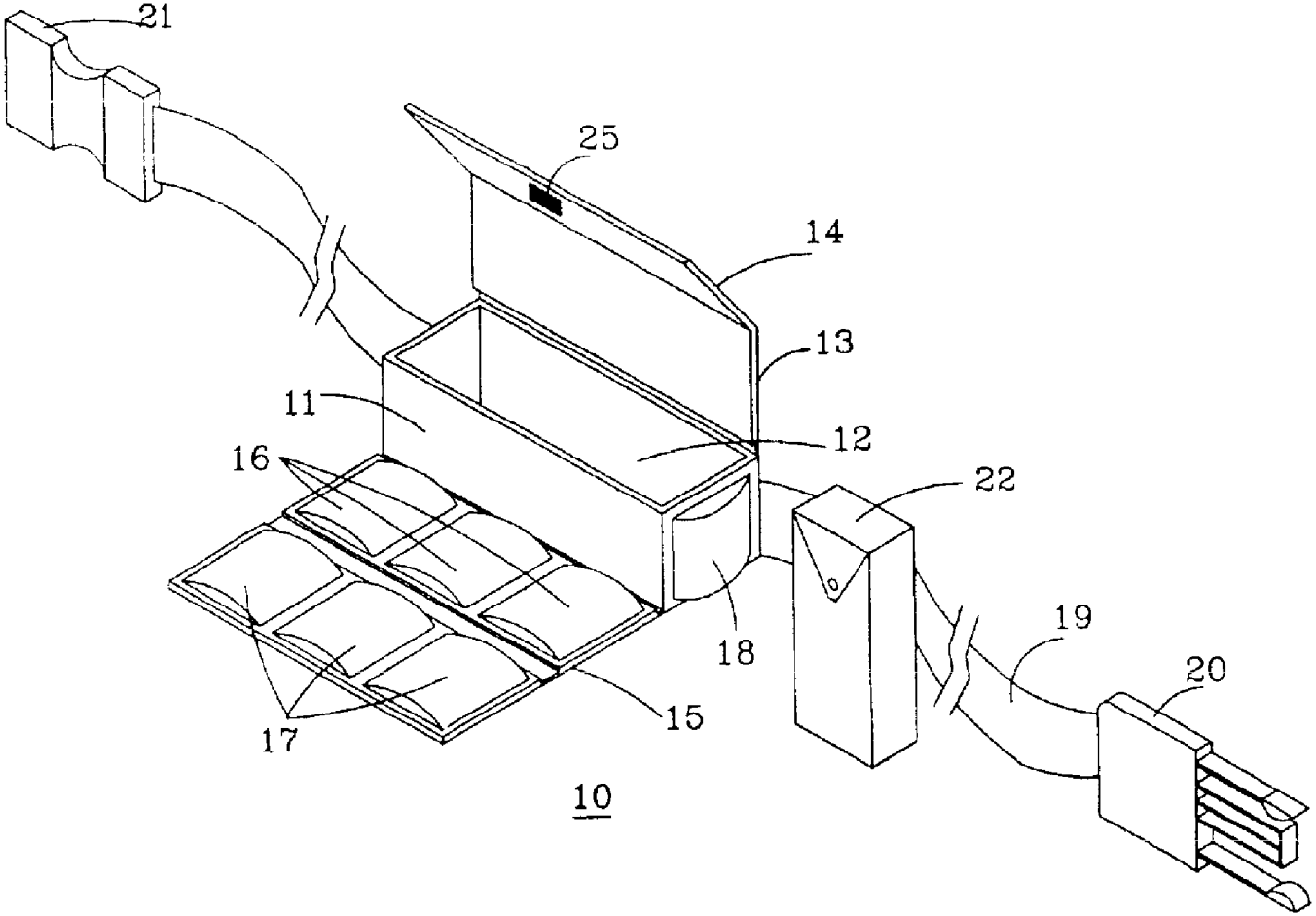
FIG. 1 is an isometric view of the utility belt assembly of the present invention.

The invention is a utility belt assembly for carrying and storing, for example, a electronic game, digital camera, a cellular phone, and supplies and attachments therefore. FIG. 1 is an example of a utility belt assembly 10 having a container 11 with a compartment 12. Compartment 12 can be used to carry for example, electronic games and digital cameras. Attached to the back side of container 11 is a folding cover including two parts 13 and 14.

Attached to the front of compartment 12 are two sets of pouches mounted on a folding platform 15. Pouches 16 and 17 may be constructed with a stretchable material to allow the insertion of, for example, game cartridges, batteries, memory devices, and other items that may be used with, for example, electronic hand games and cameras. Compartments 16,17 may be made of an elastic material to allow expansion to accommodate articles of various sizes and to hold the articles in place in each compartment. A compartment may be mounted on the end of compartment 12, for example compartment 18. It may also be of an elastic material.

The utility belt assembly includes a belt 19 having a fastening device 20, 21 attached to each end of belt 19. A particular design of fastening device is illustrated, but belt 19 may be secured around a persons waist with one of a buckle, hook and loop fastener, and snap fastener. One or more pouches or containers may be attached to belt 19. For example, container 22 is mounted on belt 19 and may hold, for example, a cellular phone, or other devices and equipment accessories.

Cover 14 has a fastener 24 on the inside edge. A mating fastener 26 (not illustrated) is on platform 15 (see FIG. 2). Fasteners 25,26 may be hook and loop, snap, or any other suitable type. Fasteners 25,26 hold folding covers 13,14 in place when container 11 is in a closed condition, as illustrated below.

Figure 2:
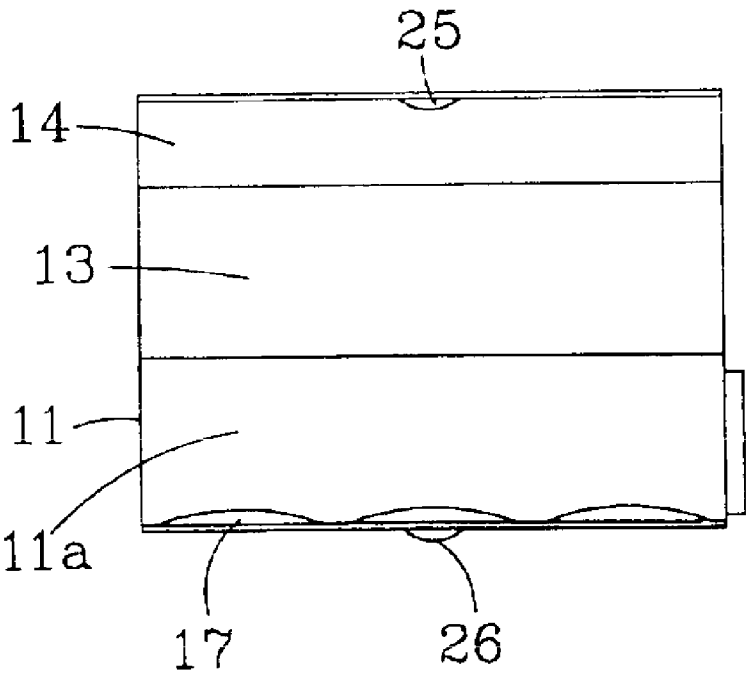
FIG. 2 is a front view of the principal container of the utility belt assembly.

FIG. 2 is a front view of container 11 in an open position, showing cover 13,14 raised, and platform 15 extending out from container 11. Compartments 17 extend across on platform 15.

Figure 3:
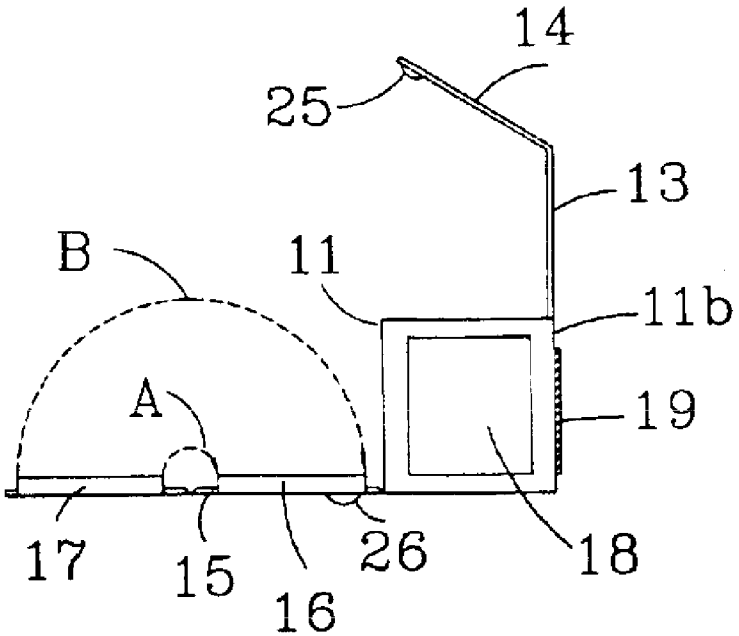
FIG. 3 is an end view of the principal container of the utility belt assembly.

FIG. 3 is an end view of container 11 showing platform 15 extending outward and cover 13,14 open and extending upward. Belt 19 is shown attached to the backside of container 11. Pouch 18 is shown on the end of container 11. Mounted on platform 15 are the two rows of compartments 16 and 17. Fastener 25 on cover 14 and fastener 26 on platform 15 are shown.

The two dashed lines A and B show the path over which compartments 17 travel when folded over compartments 16. This is the first step in closing container 11.

Figure 4:
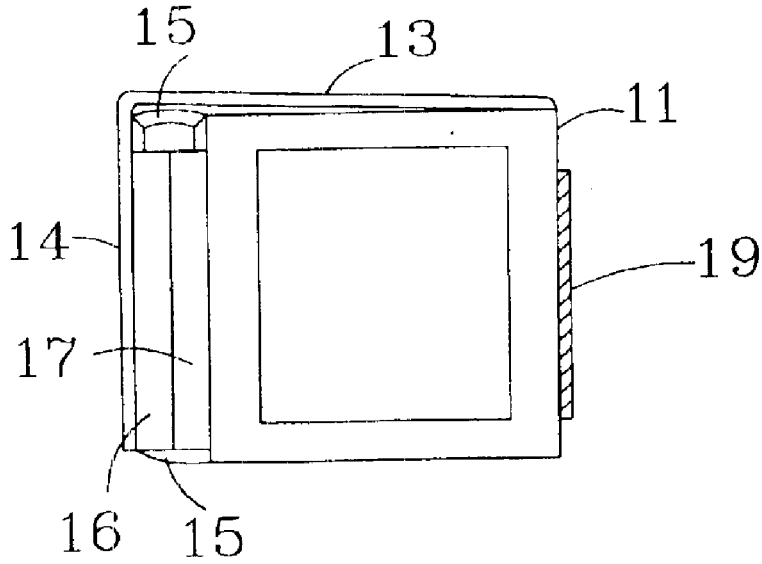
FIG. 4 is an end view of the utility belt assembly with the principal container in a closed position.

A completely closed illustration of container 11 is shown in FIG. 4. Compartments 17 have been folded over compartments 16, and the folded combination of compartments 17, 16 are then folded upward against the front side 11*a* (FIG. 2). The cover 13, 14 is folded down over the top of container 11, and over and against the folded combination of compartments 16,17. The fastener 25, on cover part 14, is secured to fastener on the bottom of platform 15 to enclosed the inside 12 of container 11, and to hold the items stored in compartments 16, 17 in place.

Figure 5:
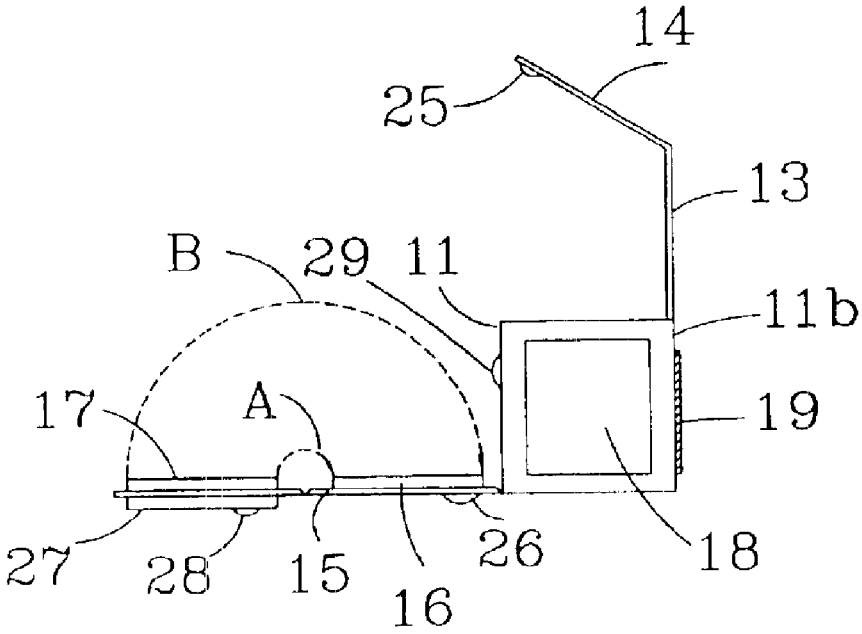
FIG. 5 is an end view of the principal container of the utility belt assembly showing an additional set of storage compartments.

FIG. 5 is similar to FIG. 3 with an additional set of compartments 27 under compartments 17. To secure the sets of compartments in a folded stored position, hook and loop fasteners 28 and 29 are used. When compartments 17, 27 are fold over onto compartments 16, and then folded upward against container 11, fasteners 28 and 29 will hold the folded assembly against container 11.

What is claimed is:

1. A utility belt assembly, comprising:

a belt;

a container attached to said belt, said container including:

a storage compartment;

at least two rows of additional compartments, a first row of compartments folding over and against a second row of compartments;

a folding cover/enclosure; and a folding platform having including said first and second row of compartments.

2. The utility belt assembly according to claim 1, wherein said first row and second row of folded rows of compartments on said platform fold upward in a stored position.

3. The utility belt assembly according to claim 1, including a compartment on an end of said container.

4. The utility belt assembly according to claim 1, including at lease one second container attached to said belt.

5. The utility belt assembly according to claim 1, wherein said folding cover/enclosure, when closed, encloses said storage compartment, said folding platform, and said first row and second row of folded compartments.

6. The utility belt assembly according to claim 1, wherein said compartments are made of an elastic material.

7. A utility belt assembly, comprising:

a belt;

a container attached to said belt, said container including:

a storage compartment;

a folding cover/enclosure; and a folding platform having a first row of compartments folding over and against a second row of compartments.

8. The utility belt assembly according to claim 7, wherein said folded rows of compartments on said platform fold upward in a stored position.

9. The utility belt assembly according to claim 7, including a compartment on an end of said container.

10. The utility belt assembly according to claim 7, including at lease one second container attached to said belt.

11. The utility belt assembly according to claim 7, wherein said folding cover/enclosure, when closed, encloses said storage compartment, said folding platform, and said first row and second row of folded compartments.

12. The utility belt assembly according to claim 7, wherein said compartments are made of an elastic material.

13. A utility belt assembly, comprising:

a belt;

a container attached to said belt, said container including:

a storage compartment;

a folding cover/enclosure; and a folding platform having a first row of compartments folding over and against a second row of compartments.

14. The utility belt assembly according to claim 13, including compartments on two sides of said folding platform.

* * * * *